US005682717A

United States Patent [19]

Carranza-Aubry

[11] Patent Number: 5,682,717

[45] Date of Patent: Nov. 4, 1997

[54] PREFABRICATED SUPPORT ELEMENTS AND METHOD FOR IMPLEMENTING MONOLITHIC NODES

[76] Inventor: Rene Carranza-Aubry, AV. Nuevo Leon 249, Planta Baja, Hipodromo Condesa, Mexico, 06100

[21] Appl. No.: 564,455

[22] Filed: Nov. 29, 1995

[30] Foreign Application Priority Data

Nov. 30, 1994 [MX] Mexico ..... 94/09263

[51] Int. Cl.[6] ..... E04B 1/00

[52] U.S. Cl. ..... 52/251; 52/252; 52/259; 52/742.14

[58] Field of Search ..... 52/251, 252, 259, 52/742.14

[56] References Cited

U.S. PATENT DOCUMENTS

| | | | |
|---|---|---|---|
| 3,662,506 | 5/1972 | Dillon | 52/251 X |
| 4,050,213 | 9/1977 | Dillon | 52/742.14 |
| 4,081,935 | 4/1978 | Wise | 52/252 X |
| 5,123,200 | 6/1992 | Simenoff | 52/259 X |

FOREIGN PATENT DOCUMENTS

| | | | |
|---|---|---|---|
| 813371 | 7/1955 | United Kingdom | 52/259 |

*Primary Examiner*—Wynn E. Wood
*Assistant Examiner*—Timothy B. Kang
*Attorney, Agent, or Firm*—Nikaido, Marmelstein, Murray & Oram LLP

[57] ABSTRACT

Prefabricated vertical and horizontal support elements. The vertical support elements consist of columns which have breaches on the concrete at the floor levels. The horizontal support elements are made of supporting and rigidity beams, that have protruding elements which can be inserted in the cited breaches of the columns. Every protruding element of every beam is inserted between the vertical rods of the column into which it is assembled. The beams are held in place by other rods that are laid longitudinally. These rods are anchored to the beams by means of protruding steel rods or similar devices before the concrete is poured.

5 Claims, 3 Drawing Sheets

PREFABRICATED SUPPORT ELEMENTS AND METHOD FOR IMPLEMENTING MONOLITHIC NODES

The present invention relates to the assembly of beams into columns that form monolithic junctions.

Although a building technique of using prefabricated elements is in itself widely known, it is also known that such a method has not been yet optimized, because the process of joining each of the different types of construction elements is both slow and complex. These inconveniences make construction costs high, making them even higher when building a structure of several floors. Up until now, concrete or metallic brackets or corbels were used on the columns that need "soldering" and metallic accessories encased in the beams and brackets in order to transmit the tensions produced by positive and negative momentum generated by the seismic forces or by the wind (horizontal forces).

This invention consists of the improvements made on prefabricated vertical and horizontal support elements. The vertical support elements consist of precast columns which have breaches in the concrete at the floor levels. The horizontal support elements are made of load supporting beams and rigidity or stiffening truss beams, that have protruding elements on each end which can be inserted in the breaches of the precast columns. Every protruding element of every beam is inserted between the vertical rods of the column into which it is assembled. The beams are further held in place by other rods that are laid longitudinally. These rods are anchored to the beams by means of protruding steel rods or similar devices before the concrete is poured.

This invention also refers to a special method of building monolithic junctions. This method is characterized by the following stages:

1. placing the precast ends of the precast beam in the column's breaches.
2. setting the rods longitudinally on the precast beams (negative steel);
3. joining the rods with hooks or stirrups or special devices; and
4. pouring the empty space of the precast column, thus forming the monolithic junction.

This invention is about the improvements made to prefabricated support elements. The assembly of beams into columns that form a monolithic junctions solves the connection problem by making it a whole unit, allowing the builder to omit accessories and additional welding.

An advantage of the present invention is that it gives a ductility factor of Q=2. This means the resulting structure has the same properties as one poured in situ, without "cold" junctions between beams and columns.

In this application, "negative steel" is the reinforcing steel that takes the tension for negative bending moments, and is generally located in the upper part of the beam. "Positive steel" is the reinforcing steel that takes the tension for positive bending moments, and is generally located in the lower part of the beam.

BRIEF DESCRIPTION OF THE DRAWINGS

These and other objects and advantages of the present invention will be made clear as we go on describing the attached drawings, in which the same reference numbers represent similar parts.

DETAILED DESCRIPTION OF THE INVENTION

Figure 1:
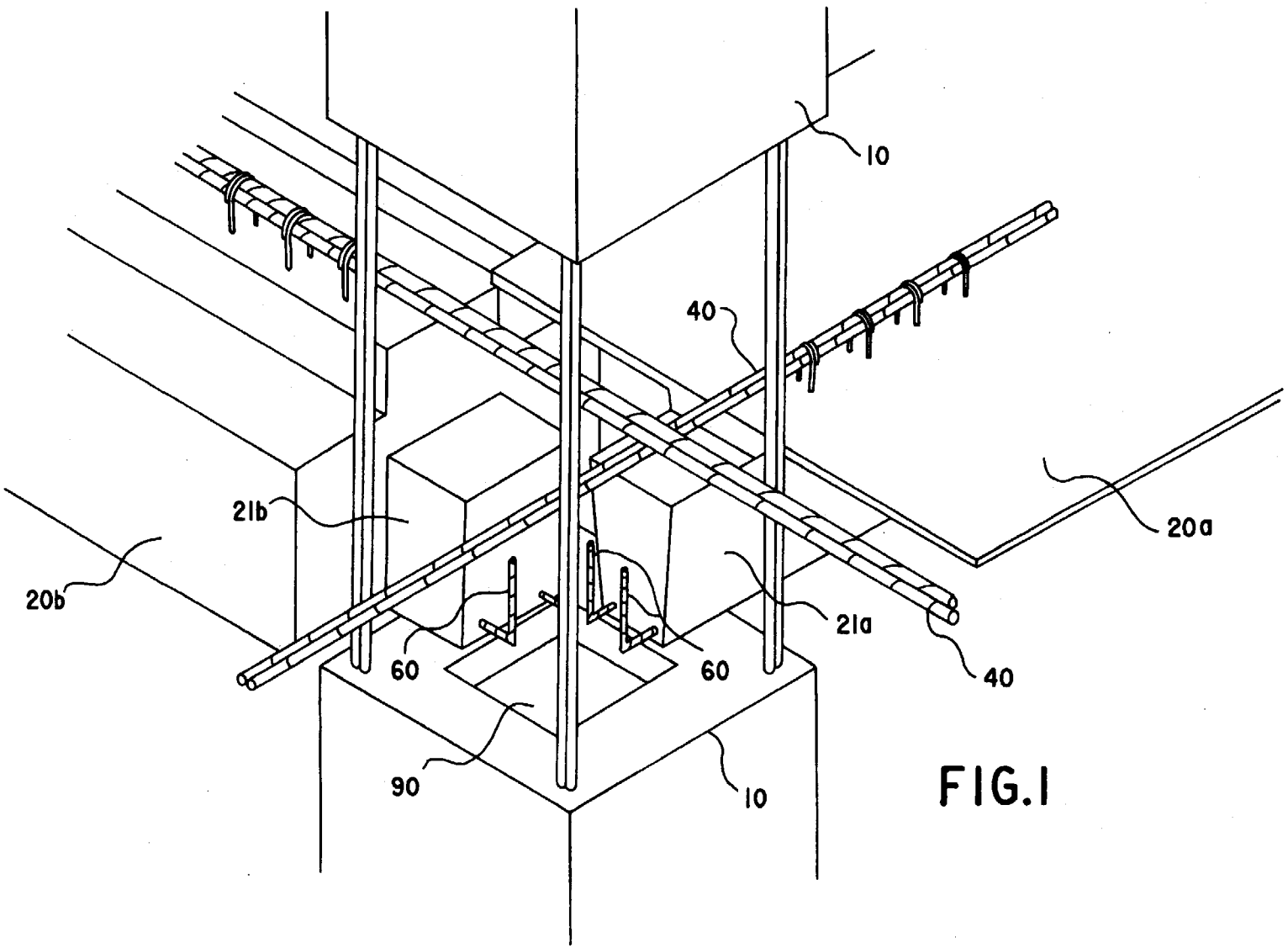
FIG. 1 is an exploded perspective view of the prefabricated support elements mounted on a column, as stated in this invention.
Figure 2:
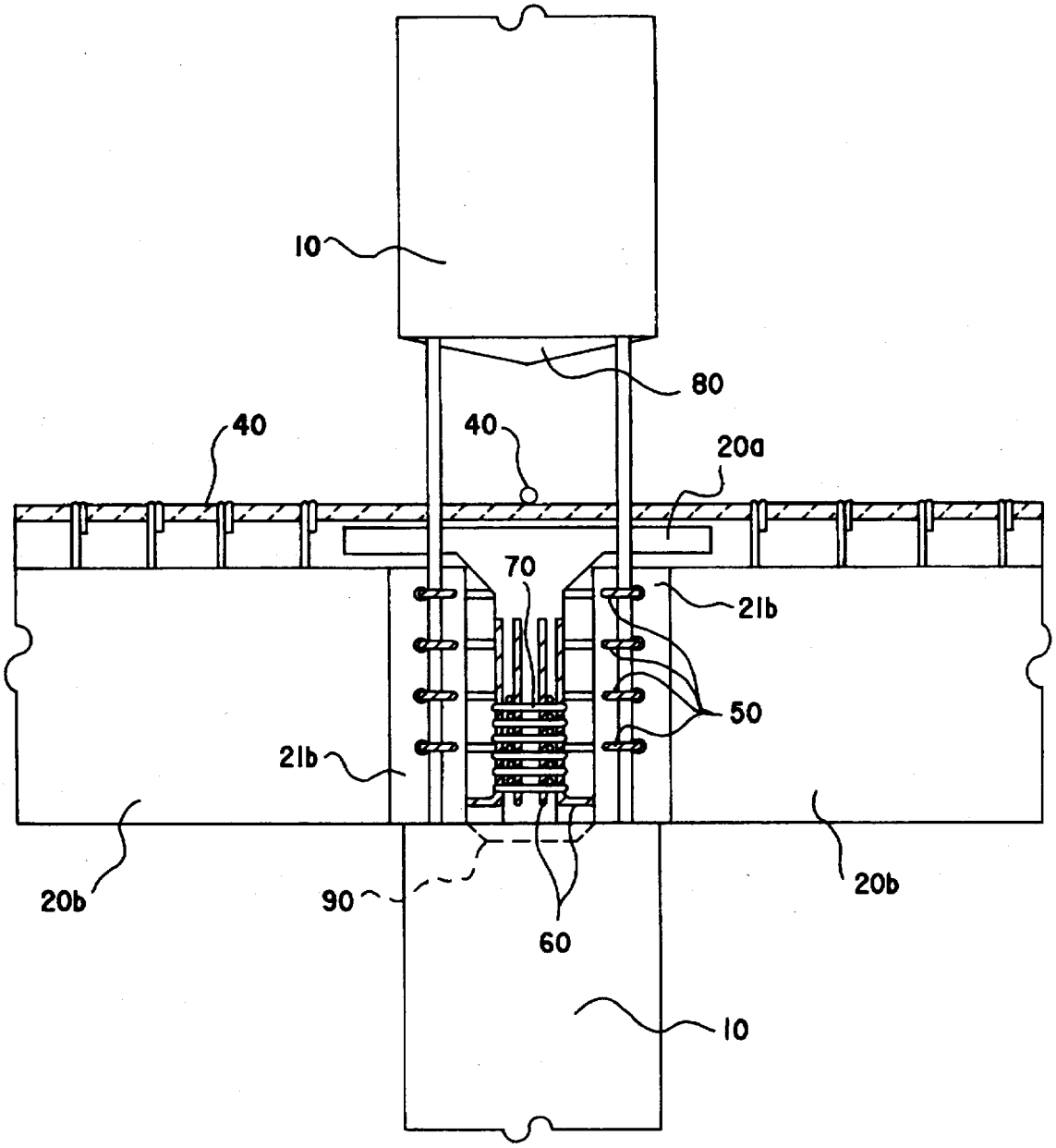
FIG. 2 is a vertical elevated view of a cut in the column that shows in detail both, the anchors of the rods between the beams and between the beams and the column.
Figure 3:
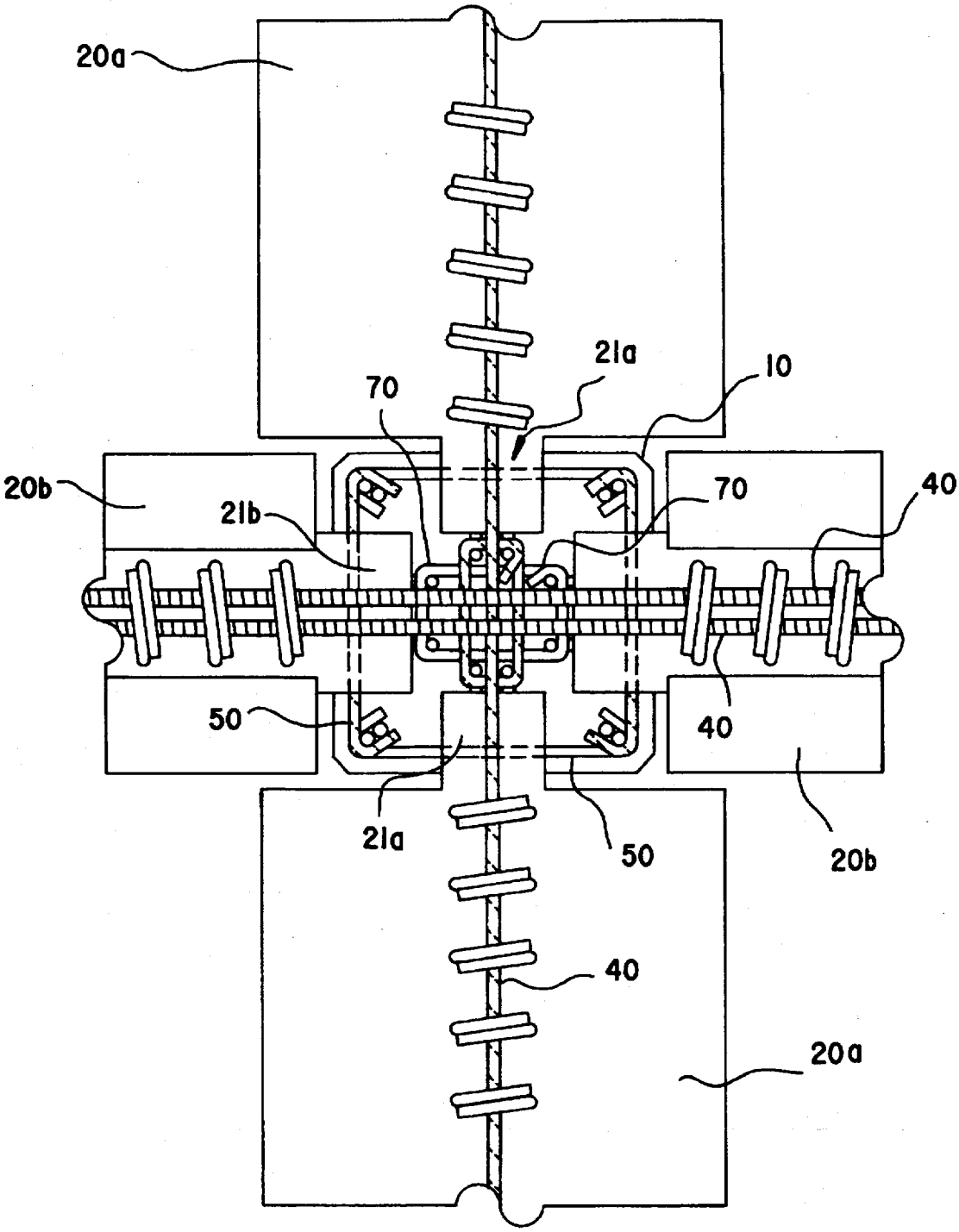
FIG. 3 is a top view showing a cut of the column with the beams according to the present invention.

One specific purpose of this invention is that, in the process of prefabricating the columns 10 of one piece for several floors, the concrete is interrupted at the point where the stiffening truss beams 20*a* and load-supporting beams 20*b* will be borne up, but the rods run throughout the column, thus forming gaps of sizes such that allow the assembly of the projection 21*a* of the stiffening truss beams 20*a* and the projections 21*b* of the load-supporting beams 20*b*. These projections rest on the breaches of the columns 10 only to the minimum extent necessary, in order to have the required area for ready-mix concrete crushing strength. Around the open nodes thus formed, the stiffening truss beams 20*a* and the load-supporting beams 20*b* will bear perpendicular steel rod projections made of positive steel 60, protruding from their own face forming a right angle upwards or forming a horseshoe, so that with stirrups 70 these can be joined with the positive steel rods forming perpendicular protrusions, from the opposite beam. After having assembled the beams 20*a* and 20*b* in this way on the column 10, and having bracketed or linked with reinforcing steel the positive steels of the opposing beams, the rest of the steel stirrups 50 are placed in the joint. Concrete is then poured, preferably together with the compression layer over the prefabricated concrete and having also placed the negative steel 40 required over the beams. External molds are positioned around the open node prior to pouring (four corner molds). The pour of the concrete in situ which fills the corners covering the column rods and stirrups makes the monolithic junction (node).

The typical sizes of columns begin in cross section of 50 cm by 50 cm and can go until it is necessary for the desired strength. The width of the beams must be approximately one half of the column side (min. 25 cm) and be inserted at least 10 cm inside the column. The dimensions are calculated to resist the total vertical reaction of the beam over the column. The reinforcing bars can be from #5 on up as necessary to give enough strength.

Although we have described and illustrated here one preferred way of implementing this invention, it is obvious that those experts in the field will be able to come up with some changes, nevertheless maintaining its essence and scope It is our intention that the above description and drawings attached be considered only as an illustration and by no means a limitation to the invention, given that its reach is only defined in terms of the claims that follow.

What is claimed is:

1. Prefabricated support elements comprising vertical supports and horizontal supports, said vertical supports being concrete columns with breaches in the concrete at each desired floor level and having vertical reinforcing rods continuously extending across each said breach, said horizontal supports being beams, each beam having a concrete protrusion inserted into one of said breaches, each protrusion of each one beam being fitted between said vertical rods of a side of the column into which said protrusion is assembled, said beams including horizontal rods, said beams being fastened to each other with said horizontal rods that run from the beam that rests on the column through said breach to a longitudinally opposing beam, said horizontal rods being anchored with other rods to said beams, before concrete is poured in situ filling said breaches and forming a monolithic junction.

2. Prefabricated support elements in accordance with claim 1, further comprising rod projections on the horizontal supports, extending out of a lower side of the beam.

3. Method of forming monolithic junctions comprising the following steps: forming concrete columns with breaches in the concrete at each desired floor level and having vertical reinforcing rods that continuously extend across each breach; erecting said columns; forming beams having concrete protrusions, inserting said protrusions of said beams into said breaches; fitting each protrusion of each one beam between vertical rods of a side of the column into which said protrusion is assembled; putting horizontal rods longitudinally on top of the beams and through the breach; joining the horizontal rods with hooks or stirrups to the beams; and pouring concrete into the breach of the column, forming the monolithic junction.

4. Method of forming monolithic junctions, in accordance with claim 3, wherein said protrusions of the horizontal support beams are perpendicular to the lower side of the beam, and include positive steel rods that protrude from an end face of the beam, said method further comprising forming a right angle or a horseshoe shape from which to hook or brace the positive steel rods of a longitudinally opposing horizontal beam; hooking or bracing the positive steel rods of opposing beams with reinforcing steel; after having assembled in this fashion the beams concurring on the column, and having "hooked" or braced with reinforcing steel the positive steel rods of the opposing beams, the concrete is poured to form the junction.

5. Method of forming monolithic junctions, in accordance with claim 4, wherein said horizontal rods are negative steel rods on said horizontal beams and said method further comprises extending said negative steel rods from one beam through said breach to said longitudinally opposing beam, and pouring additional concrete to form a compression layer over said beams and said horizontal rods at the same time as pouring the concrete into the breach.

* * * * *